US005875926A

United States Patent [19]

Schwartz

[11] Patent Number: 5,875,926

[45] Date of Patent: Mar. 2, 1999

[54] CYLINDRICAL BARREL, LINEAR, SLIDE TRIGGER

[75] Inventor: John J. Schwartz, Cincinnati, Ohio

[73] Assignee: The Procter & Gamble Company, Cincinnati, Ohio

[21] Appl. No.: 756,998

[22] Filed: Nov. 26, 1996

[51] Int. Cl.[6] ..... B05B 7/02

[52] U.S. Cl. ..... 222/79; 222/174; 222/505; 239/526; 239/578

[58] Field of Search ..... 222/79, 174, 505; 239/526, 578

[56] References Cited

U.S. PATENT DOCUMENTS

| | | | |
|---|---|---|---|
| 1,979,014 | 10/1934 | Schleif | 222/79 |
| 2,249,608 | 7/1941 | Greene | 222/79 |
| 2,698,700 | 1/1955 | Grosh | 222/79 |
| 2,724,528 | 11/1955 | Hersey | 222/79 |
| 2,753,079 | 7/1956 | Hersey | 222/79 |
| 2,936,097 | 5/1960 | Loria et al. | 222/79 |
| 3,040,932 | 6/1962 | Barricks | 222/79 |
| 3,318,482 | 5/1967 | Voce | 222/79 |
| 3,361,300 | 1/1968 | Kaplan | 222/79 X |
| 3,841,526 | 10/1974 | Haskins | 222/79 |
| 4,640,444 | 2/1987 | Bundschuh | 222/321 |
| 4,762,253 | 8/1988 | Palmert | 222/145 |
| 4,819,835 | 4/1989 | Tasaki | 222/383 |
| 4,961,694 | 10/1990 | Gardetto | 417/464 |
| 5,390,397 | 2/1995 | Kremer et al. | 24/662 |
| 5,536,095 | 7/1996 | Diamond | 401/146 |

FOREIGN PATENT DOCUMENTS 2 209 004 4/1989 United Kingdom .

*Primary Examiner*—Kevin P. Shaver
*Attorney, Agent, or Firm*—Elizabeth M. Koch

[57] ABSTRACT

A slide trigger for a liquid delivery system has a handle and a retractable trigger assembly. The handle has a grip portion and a barrel portion with a guide. The trigger assembly has a slide which travels freely within the guide and a trigger portion attached to the slide which activates the liquid delivery system when the trigger portion is retracted.

9 Claims, 3 Drawing Sheets

CYLINDRICAL BARREL, LINEAR, SLIDE TRIGGER

FIELD OF THE INVENTION

This invention relates to the field of trigger sprayers, and more particularly, to a cylindrical barrel, linear slide trigger.

BACKGROUND OF THE INVENTION

Conventional trigger liquid sprayers utilize a sprayer nozzle at a front end, a pump operated by a trigger and a container mounted to the nozzle. The trigger typically moves in a rectangular geometry consisting of a slide traveling over a guide consisting of a single rib such that the slide encompasses the guide. This results in opposing forces acting on the single rib causing a change in the geometry that actually reduces or constricts the path of travel due to the moments created by the slide. Deformation of the guide and slide is further compounded by the lack of a mechanism to counter these forces. The rectangular geometries also result in increased surface area interaction between the mating surfaces, flat to flat. Any imperfections of the surfaces results in increased friction between the surfaces making the system even more sensitive to mold wear and conditions.

In addition, the conventional guide and slide are comprised of a relatively narrow and long geometry. This poses problems with the molding of these parts as the guide and slide are susceptible to warpage and tolerancing problems. Tight tolerances are required for effective operation of conventional trigger sprayers. Therefore, any tolerancing problems result in an ineffective trigger sprayer. Furthermore, tighter tolerancing increases the negative effect of warpage on the trigger system. Combined, these problems add to the overall force required to move the system and in some cases cause the system to "freeze" or "lock" altogether.

Due to the relatively small cross sectional area of the conventional rectangular trigger system, the forces required to move the system are concentrated over a much smaller area. This results in excessive deflection of the geometry which further compounds the binding problem.

Therefore, what is needed is a cylindrical barrel, linear slide trigger which eliminates the conventional rectangular geometry trigger system.

SUMMARY OF THE INVENTION

Accordingly, it is an object of the present invention to provide an improved trigger sprayer.

It is a further object of the present invention to provide a slide trigger for a liquid delivery system, includes a handle having a grip portion and a barrel portion with a guide, and a retractable trigger assembly having a slide which travels freely within the guide and a trigger portion attached to the slide which activates the liquid delivery system when the trigger portion is retracted.

DETAILED DESCRIPTION OF THE INVENTION

Figure 1:
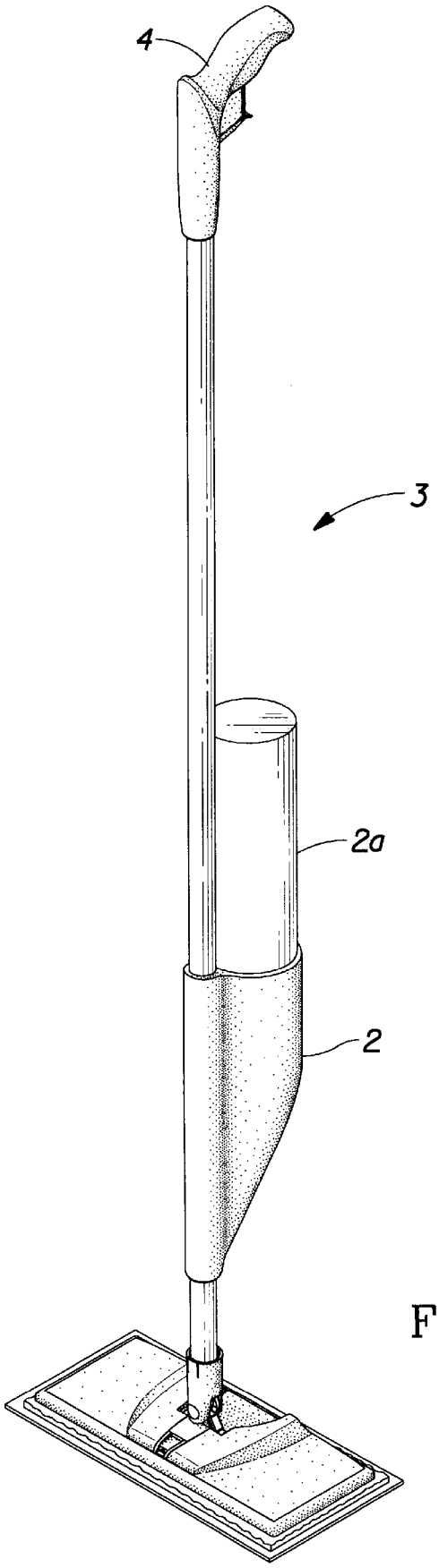
FIG. 1 is a perspective view of a cleaning implement which utilizes the slide trigger according to the preferred embodiment of the present invention.

Referring to FIG. 1, the preferred slide trigger 1 for activating a liquid delivery system 2 having a liquid filled canister 2*a,* both of which are attached to a cleaning implement 3. However, the preferred slide trigger 1 may be utilized in a variety of applications without deviating from the intent of the invention.

Figure 2:
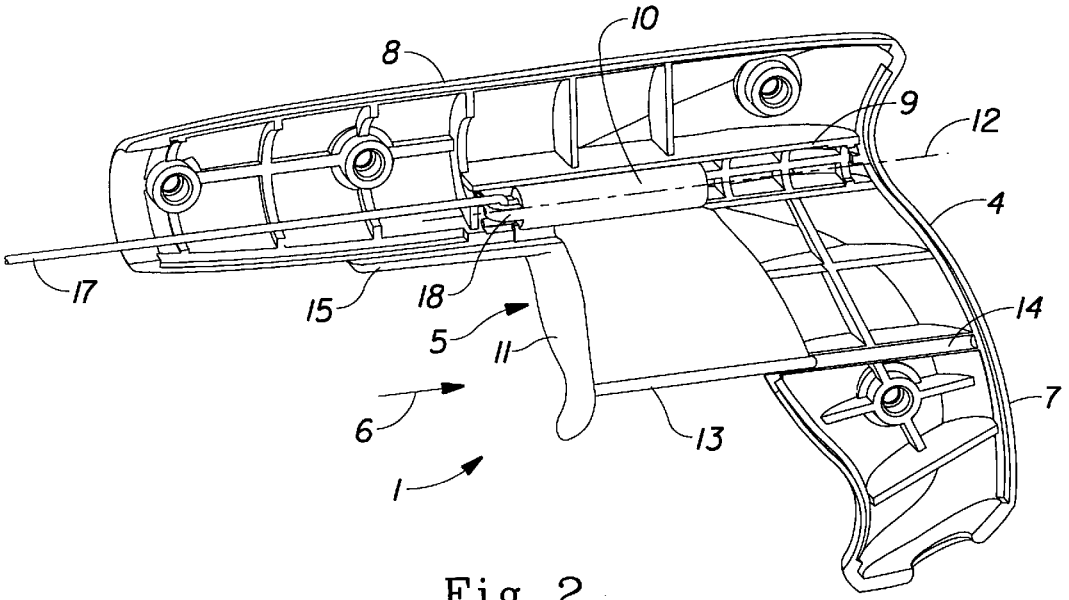
FIG. 2 is a side view of one half of the handle shown in FIG. 1 with the slide trigger in a rest position according to the preferred embodiment of the present invention.
Figure 3:
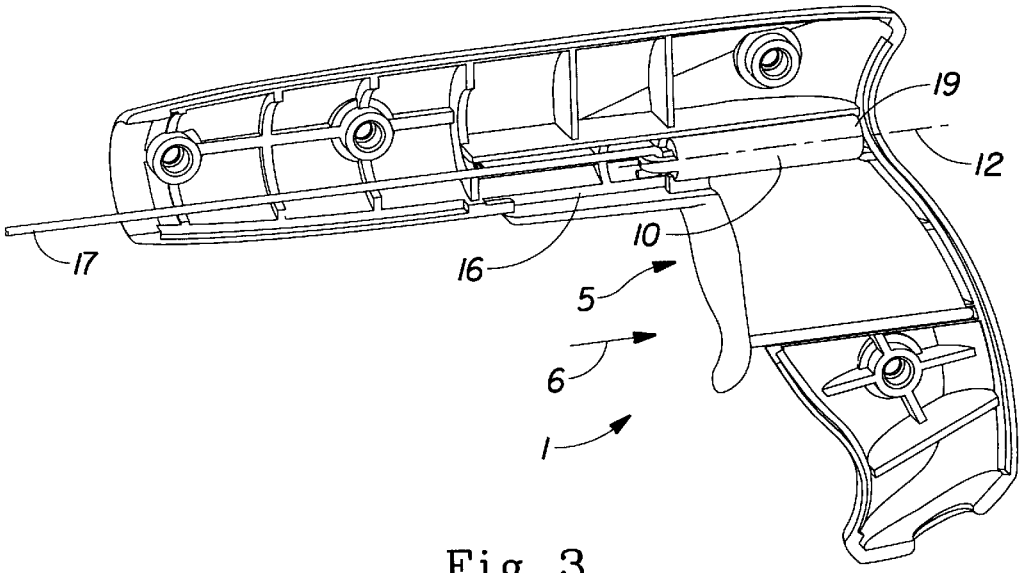
FIG. 3 is a side view of one half of the handle shown in FIG. 1 with the slide trigger in a retracted position according to the preferred embodiment of the present invention.
Figure 4:
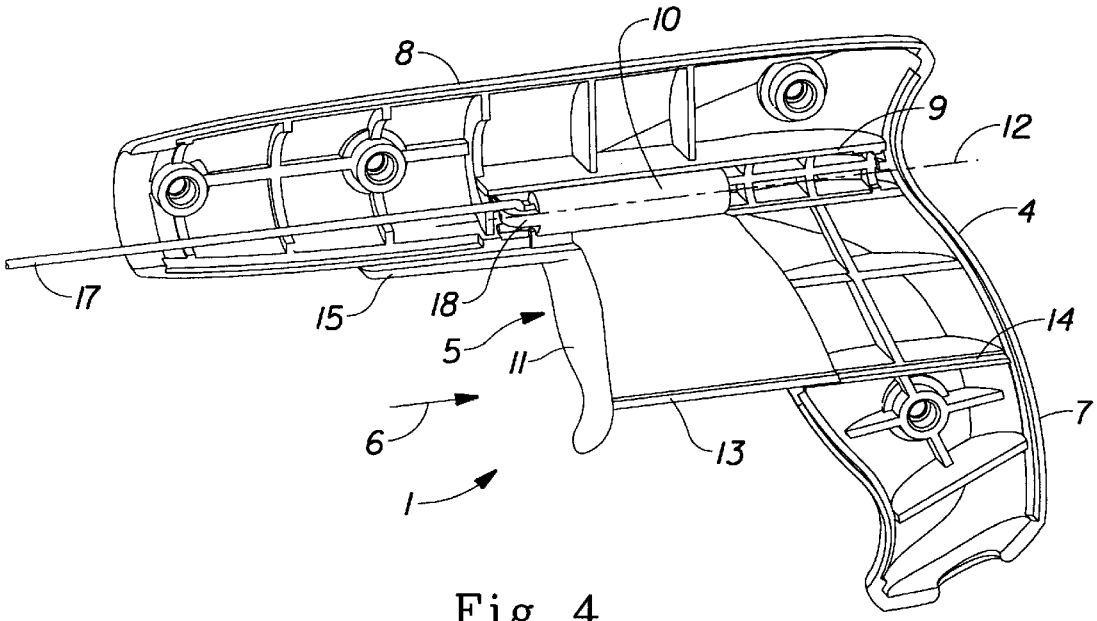
FIG. 4 is a side view of one half of the handle shown in FIG. 1 with the slide trigger in a rest position according to the second embodiment of the present invention.
Figure 5:
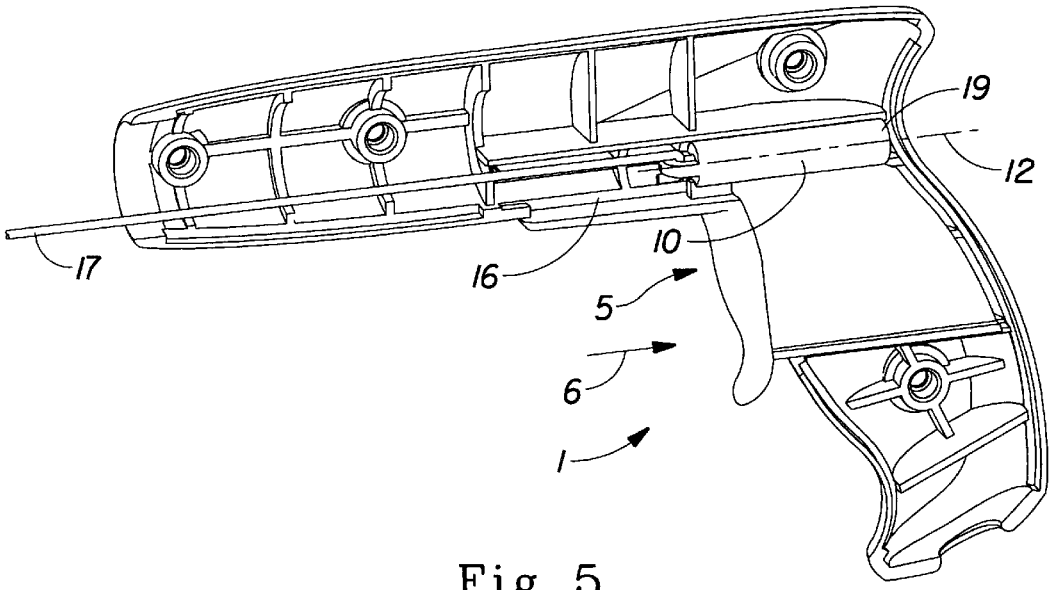
FIG. 5 is a side view of one half of the handle shown in FIG. 1 with the slide trigger in a retracted position according to the second embodiment of the present invention.

Referring to FIGS. 2 and 3, the preferred trigger 1, one half of the handle shown in FIG. 1, has a handle 4 and a trigger assembly 5 positioned within the handle 4 for activating the liquid delivery system 2 when the trigger assembly 5 is moved in a direction 6 from a rest position (FIG. 2) to a retracted position (FIG. 3).

The handle 4 has a grip portion 7 and a barrel portion 8 which is preferably attached to a handle 3*a* of the cleaning implement 3 (FIG. 1). A guide 9 is positioned within the barrel portion 8 for receiving the trigger assembly 5. Preferably, the guide 9 is linear and has a cylindrical, ribbed groove.

The trigger assembly 5 has a slide 10 and a trigger portion 11. The barrel-shaped slide 10 travels freely within the ribbed, cylindrical guide 9 along a linear axis 12. Preferably, the slide 10 is barrel-shaped but may comprise any polygonal cross section without deviating from the intent of the invention. The cylindrical shaped geometry of the guide 9 and slide 10 reduces frictional forces found in conventional rectangular shaped geometries as the cylindrical geometry has only a point contact and not a flat surface contact as in conventional slide geometries. The cylindrical geometry enables the slide to travel more freely without binding or warping. The ribbed interior of guide 9 also reduce surface contact.

The trigger assembly 5 also has a backup slide 13 which travels freely within a second guide 14 of the grip portion 7. Preferably, both the backup slide 13 and the guide 14 have a ribbed cylindrical cross section both of which reduce surface contact and thus, friction. However, as with the slide 10 and the guide 9, the slide 13 and the guide 14 may comprise any polygonal cross section without deviating from the intent of the invention.

A slide shield 15 is attached to the trigger assembly 5 for safely shielding an opening or relief 16 (FIG. 3) created when the trigger assembly 5 is retracted. A connection rod 17 is connected to a first end 18 of the slide 10 and to the liquid delivery system 2, within the handle 3*a* of the cleaning implement 3.

In the rest position (FIG. 2), the connection rod 17 applies a constant force on the trigger assembly 5 which prevents the trigger assembly 5 from being inadvertently activated, thus prematurely releasing liquid from the liquid delivery system 2. To activate the trigger assembly 5, and subsequently the liquid delivery system 2, a force is applied to the trigger portion 11 in the direction 6 which is sufficient to overcome the tension created by the connection rod 17.

In the retracted position (FIG. 3), the trigger portion 11 travels freely in the direction 6 until a second end 19 of the slide 10 engages the grip portion 7. After the trigger assembly 5 is retracted, the liquid delivery system 2 will be activated depending on the degree of retraction. Therefore, a partially retracted trigger assembly 5 will partially dispense liquid from the liquid delivery system 2.

The preferred slide trigger 1 utilizes both slides 10 and 13 within guides 9 and 14, respectively. In this way, the moment generated by using only the first slide 10 within the first guide 9 is offset by the stabilizing support of the backup slide 13 within the backup guide 14. Also, any deflections will be transferred to the guides 9, 14, which results in the travel path within the guides 9, 14, expanding rather than constricting as in the conventional rectangular slide/guide geometries.

The stabilized slide trigger 1 has numerous advantages over the prior art. For example, the tolerances of the slides 10, 13 and the guides 9, 14 are not as critical as the tolerances of conventional trigger systems due to the geometry of the preferred slide trigger 1 which results in cheaper parts and a more efficient system. Furthermore, the preferred slide trigger 1 has less warpage, which is common in conventional trigger sprayers, due to the lower tolerances and the increased support from the integral rib structure within the guides 9, 14.

In addition, due to the relatively large cylindrical geometry of the preferred slide trigger 1 as compared to smaller conventional rectangular geometry trigger systems, the forces required to retract the preferred trigger 1 are concentrated over a much larger area with minimal direct surface contact. This results in a reduction of the deflection of the geometry which reduces binding or locking of the trigger 1 as the preferred trigger 1 is more tolerant to deflections.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A slide trigger for a liquid delivery system, comprising:

a handle having a grip portion and a barrel portion with a guide; and a retractable trigger assembly having a barrel-shaped slide which travels freely within said guide and a trigger portion attached to said slide which activates the liquid delivery system when said trigger portion is retracted.

2. The slide trigger of claim 1, further comprising a second slide of said trigger assembly for engaging a second guide of said grip portion.

3. The slide trigger of claim 2, wherein said second slide travels freely along a linear axis of said second guide.

4. The slide trigger of claim 2, wherein said second slide is barrel-shaped and travels freely within said second guide.

5. The slide trigger of claim 2, wherein said second guide is at least one of linear, ribbed, and cylindrical.

6. The slide trigger of claim 1, further comprising a connection rod attached at a first end of said slide and at a second end to the liquid delivery system for activating the liquid delivery system when said retractable trigger is retracted.

7. The slide trigger of claim 1, wherein said guide is at least one of linear, ribbed, and cylindrical.

8. The slide trigger of claim 1, further comprising a slide shield of said trigger assembly for shielding an opening created in said handle when said trigger assembly is retracted.

9. The slide trigger of claim 1, wherein said barrel-shaped slide travels freely along a linear axis of said guide.

* * * * *